US009445697B2

(12) United States Patent
Wu

(10) Patent No.: US 9,445,697 B2
(45) Date of Patent: Sep. 20, 2016

(54) METALLIC TOILET LID AND SEAT AND METHOD FOR MANUFACTURING

(71) Applicant: Topseat International, Inc., Plano, TX (US)

(72) Inventor: Chengdong Wu, Allen, TX (US)

(73) Assignee: Topseat International, Inc., Plano, TX (US)

( * ) Notice: Subject to any disclaimer, the term of this patent is extended or adjusted under 35 U.S.C. 154(b) by 668 days.

(21) Appl. No.: 13/757,531

(22) Filed: Feb. 1, 2013

(65) Prior Publication Data

US 2014/0215698 A1 Aug. 7, 2014

(51) Int. Cl.
*A47K 13/00* (2006.01)

(52) U.S. Cl.
CPC ..... *A47K 13/00* (2013.01)

(58) Field of Classification Search
CPC ..... A47K 13/00; A47K 13/02; A47K 13/24
USPC ..... 4/234, 237
See application file for complete search history.

(56) References Cited

U.S. PATENT DOCUMENTS

| | | | |
|---|---|---|---|
| 840,032 | A | 1/1907 | Willms |
| 848,043 | A | 3/1907 | McCord et al. |
| 1,616,020 | A | 2/1927 | Wolf |
| 1,636,649 | A | 7/1927 | Richardson |
| 3,484,876 | A | 12/1969 | Thomas |
| 3,772,111 | A | 11/1973 | Ginsburg |
| 5,457,515 | A | 10/1995 | Quadracci et al. |
| 5,829,073 | A | 11/1998 | Lee |
| 5,896,230 | A | 4/1999 | Goggins |
| 2005/0076424 | A1 | 4/2005 | Mattingly |
| 2008/0008885 | A1 | 1/2008 | Terfloth et al. |
| 2009/0068453 | A1 | 3/2009 | Chung |

FOREIGN PATENT DOCUMENTS

| | | |
|---|---|---|
| CN | 101664289 | 3/2010 |

OTHER PUBLICATIONS

Notification of transmittal of the International Search Report and the Written Opinion of the International Searching Authority dated May 22, 2014 in connection with International Patent Application No. PCT/US2014/014487.
U.S. Office Action issued for U.S. Appl. No. 13/563,093 dated Mar. 11, 2016, 8 pgs.
European Office Action issued for EP 12774191.6 dated Apr. 11, 2016, 6 pgs.

*Primary Examiner* — Tuan N Nguyen

(57) ABSTRACT

A toilet lid or seat for use with a toilet includes first and second metallic layers bonded together along an edge to form a shell having a shape and size associated with the toilet lid or seat, the shell having an interior volume. The toilet lid or seat also includes a core structural layer disposed within the interior volume of the shell. The toilet lid or seat further includes a plurality of exterior layers disposed on exterior surfaces of the shell, the exterior layers configured to envelop the toilet lid or seat.

20 Claims, 6 Drawing Sheets

METALLIC TOILET LID AND SEAT AND METHOD FOR MANUFACTURING

TECHNICAL FIELD

This disclosure is generally directed to toilets and more particularly to a toilet lid and seat that are formed of at least one metallic material.

BACKGROUND

Toilet seats and lids have existed in various forms for many decades. A toilet seat provides a surface for an occupant to comfortably sit and a toilet lid provides a protective cover for the toilet facility. Generally, toilet seats and lids are made of wood or plastic materials. These materials can degrade, discolor, and/or become damaged over time. Thus, many toilet seats and lids may become unattractive, structurally unsound, or both. Some toilet seats have decorations and designs in various forms. However, these decorations are often not chemically resistant, scratch resistant, and durable, and do not exhibit long-lasting color fastness.

SUMMARY

According to an embodiment of the present disclosure, an apparatus for use with a toilet includes first and second metallic layers bonded together along an edge to form a shell having a shape and size associated with the toilet apparatus, the shell having an interior volume. The apparatus also includes a core structural layer disposed within the interior volume of the shell. The apparatus further includes a plurality of exterior layers disposed on exterior surfaces of the shell, the exterior layers configured to envelop the toilet apparatus.

In another embodiment, a method of manufacturing a toilet apparatus includes bonding first and second metallic layers along an edge to form a shell having a shape and size associated with the toilet apparatus, the shell having an interior volume. The method also includes applying a plurality of exterior layers on exterior surfaces of the shell, the exterior layers configured to envelop the toilet apparatus. The method further includes injecting a core structural material into the interior volume of the shell.

In still another embodiment, a toilet includes a toilet bowl and a toilet seat and toilet lid secured to the toilet bowl. At least one of the toilet seat and toilet lid includes first and second metallic layers bonded together along an edge to form a shell having a shape and size associated with the toilet seat or lid, the shell having an interior volume. The at least one of the toilet seat and toilet lid also includes a core structural layer disposed within the interior volume of the shell, and a plurality of exterior layers disposed on exterior surfaces of the shell, the exterior layers configured to envelop the toilet seat or lid.

Other technical features may be readily apparent to one skilled in the art from the following figures, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 6, described below, and the various embodiments used to describe the principles of the present disclosure in this patent document are by way of illustration only and should not be construed in any way to limit the scope of the disclosure. Those skilled in the art will understand that the principles of the present disclosure may be implemented in any type of suitably arranged device or system.

The present disclosure provides a metallic toilet lid and seat for use with a toilet bowl. The metallic toilet lid and seat according to this disclosure provide many advantages, including a smooth surface and resistance to abrasion and scratching. The metallic toilet lid and seat may be customized with one or more images to convey a message or impression that may be of interest to a user. In addition, the metallic toilet lid and seat according to this disclosure are constructed to be more durable and retain their original appearance for a longer period than conventional toilet lids and seats.

Many toilet lids and seats are constructed using materials such as wood, processed wood fiber, medium density fiberboard, urea molding compound, polyurethane resins, and thermoplastic polymers. Each of these materials results in a product that is subject to wear, scratching, abrasion, and staining. In contrast, the metallic toilet lid and seat disclosed herein provide a durable, abrasion resistant, scratch resistant, smooth surface.

Figure 1:
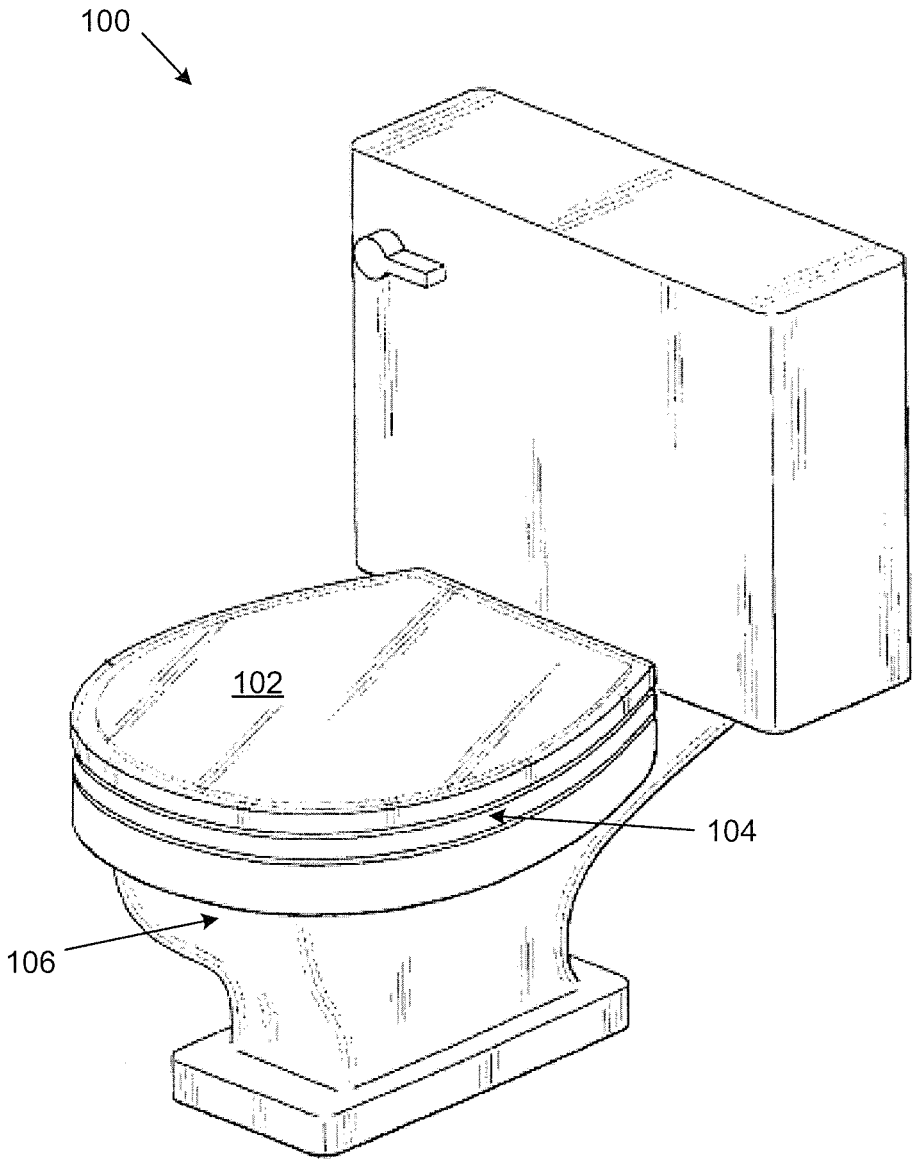
FIG. 1 illustrates a toilet with a metallic toilet lid and seat, according to embodiments of the present disclosure.

FIG. 1 illustrates a toilet with a metallic toilet lid and seat, according to the present disclosure. The embodiment of the toilet shown in FIG. 1 is for illustration only. Other embodiments of the toilet could be used without departing from the scope of this disclosure.

As shown in FIG. 1, a toilet 100 is fitted with a toilet lid 102 and toilet seat 104 over a bowl 106. The toilet 100 may be any suitable toilet with a bowl that is configured to be covered by a seat and lid. The bowl 106 has an opening that is generally round or oval in shape. The metallic toilet lid 102 and seat 104 have a size and shape configured to generally match the size and shape of the bowl 106 and to cover the opening of the bowl 106. The metallic toilet lid 102 and seat 104 are secured to a rear portion of the bowl 106 or toilet 100 using hinged hardware that allow the metallic toilet lid 102 and seat 104 to raise and lower independently with respect to the bowl 106 and to each other.

Although FIG. 1 depicts one example of a toilet 100 with a metallic toilet lid 102 and toilet seat 104, various changes may be made to FIG. 1. For example, while the bowl 106 is depicted as generally round or oval in shape, the bowl 106 could include other shapes, such as a rectangle or octagon. Likewise, the metallic toilet lid 102 and toilet seat 104 could also include other shapes in order to match, or be different from, the bowl 106.

Figure 2:
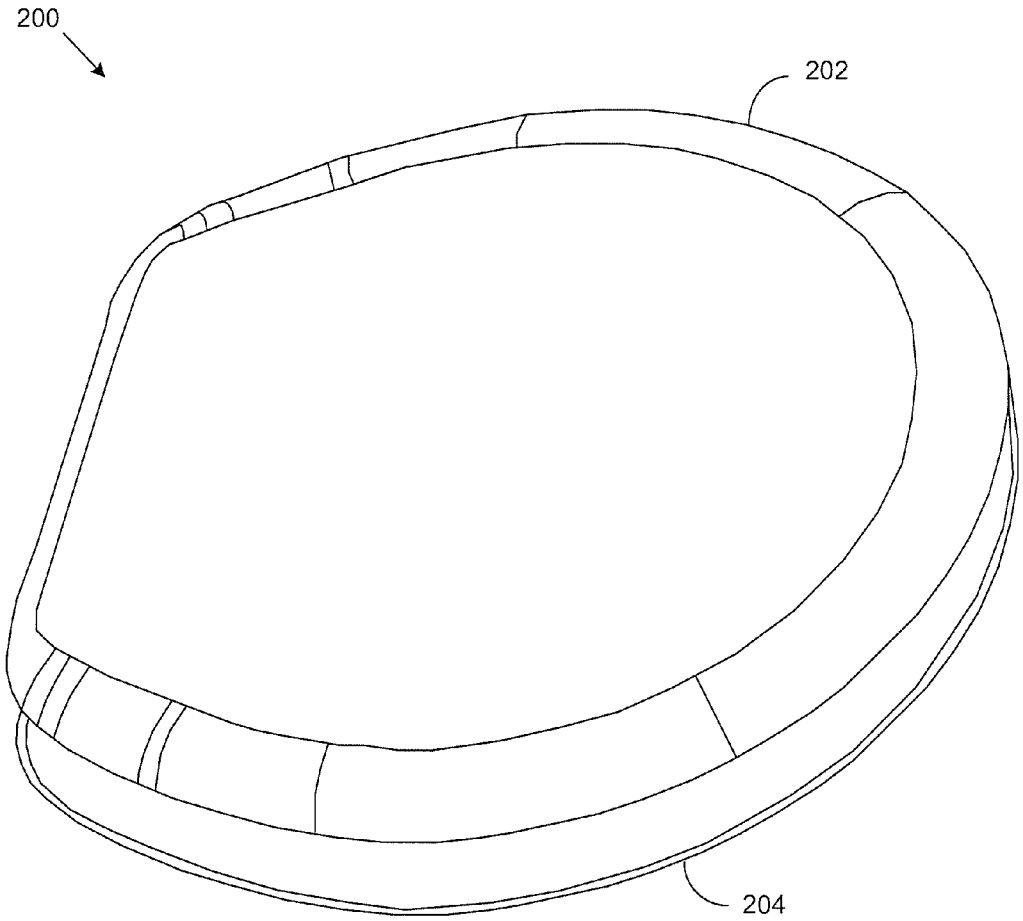
FIG. 2 illustrates a perspective view of a metallic shell forming part of a metallic toilet lid, according to embodiments of the present disclosure.

FIG. 2 illustrates a perspective view of a metallic shell forming part of a metallic toilet lid, according to embodiments of the present disclosure. The embodiment of the metallic toilet lid 200 shown in FIG. 2 is for illustration only. Other embodiments of the metallic toilet lid 200 could be used without departing from the scope of this disclosure. For ease of explanation, the toilet lid 200 may represent the toilet lid 102 of FIG. 1. It will be understood, however, that the toilet lid 200 may represent any other suitable toilet lid. The following disclosure will refer only to the toilet lid 200. However, it will be understood that the embodiments described below are also applicable to a metallic toilet seat.

As shown in FIG. 2, the metallic toilet lid 200 includes a top shell 202 and a bottom shell 204. The top shell 202 and bottom shell 204 are made of metal sheets that are formed into the shape of a toilet lid through a metal shaping process such as stamping. That is, the top shell 202 is formed in a shape of a top part of a toilet lid, and the bottom shell 204 is formed in a shape of a bottom part of a toilet lid.

In an embodiment, the top shell 202 and the bottom shell 204 are formed of carbon steel or stainless steel sheets. Each sheet may have any suitable thickness. In one embodiment, the top shell 202 and the bottom shell 204 have a thickness of approximately 1 mm. The top shell 202 and the bottom shell 204 may be formed of materials other than carbon steel or stainless steel. For example, the shells 202, 204 could be formed of aluminum, chrome, cast iron, copper, or any other suitable material.

After being formed, the top shell 202 and the bottom shell 204 are permanently bonded together to form a whole toilet lid shell, as described in greater detail below. The cavity within the whole toilet lid shell is filled with a material, such as rigid polyurethane foam. The top shell 202 and bottom shell 204 may be finished with one or more coatings or finish layers, such as a vitreous or porcelain enamel layer. This is described in greater detail below. In an embodiment, the coatings are applied prior to filling the cavity with foam.

Although FIG. 2 depicts one example of a metallic shell of a metallic toilet lid 200, various changes may be made to FIG. 2. For example, while the shells 202, 204 are described as being formed by metal stamping, other metal shaping processes could be used. For example, the shells 202, 204 could be formed by forging, casting, extruding, molding, laser cutting, bending, stretch forming, spinning, deep drawing, or any other suitable process.

Figure 3B:
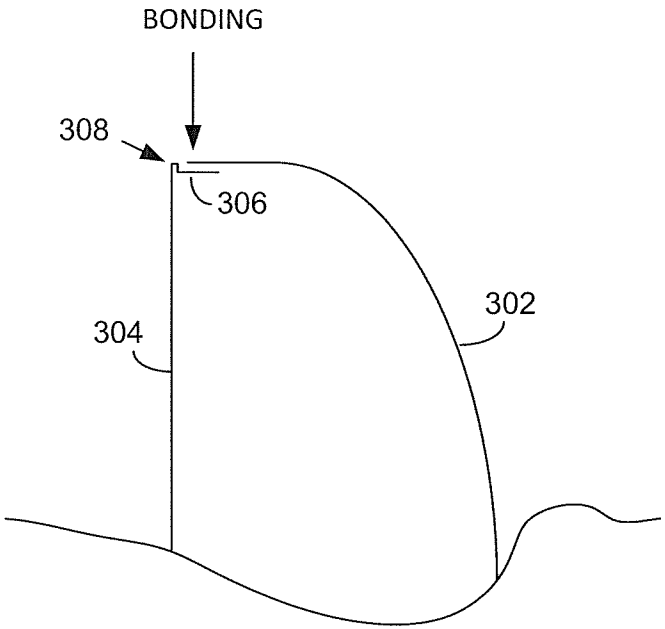
FIGS. 3A and 3B illustrate methods of combining top and bottom shells of a metallic toilet lid or toilet seat, according to embodiments of the present disclosure.
Figure 3A:
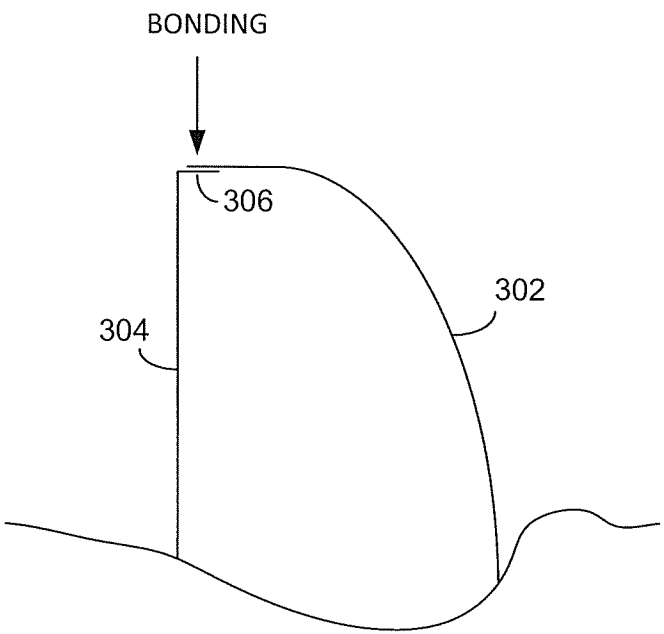

FIGS. 3A and 3B illustrate methods of combining top and bottom shells of a metallic toilet lid or toilet seat, according to embodiments of the present disclosure. The embodiments shown in FIGS. 3A and 3B are for illustration only. Other methods of combining the top shell 302 and bottom shell 304 could be used without departing from the scope of this disclosure. For ease of explanation, the top shell 302 and bottom shell 304 may represent the top shell 202 and the bottom shell 204 of FIG. 2. It will be understood, however, that the shells 302, 304 may represent any other suitable shells.

As shown in FIGS. 3A and 3B, the top shell 302 and the bottom shell 304 are bonded together to form a whole toilet lid shell or toilet seat shell. The bottom shell 304 includes a tab 306 that extends around a perimeter of the bottom shell 304. As shown in FIG. 3B, the bottom shell 304 may also include a lip 308 on the tab 306. When the top shell 302 and the bottom shell 304 are brought together, the edge of the top shell 302 extends over the tab 306. As shown in FIG. 3B, the edge of the top shell 302 may abut the lip 308 of the bottom shell 304.

The top shell 302 and the bottom shell 304 are bonded together through a metal bonding process, such as welding, chemical bonding, adhesive, or any other suitable bonding method. After bonding, any sharp or rough surfaces may be removed by polishing.

Although FIGS. 3A and 3B depict examples of combining top and bottom shells of a metallic toilet lid or toilet seat, various changes may be made to FIGS. 3A and 3B. For example, the top shell 302 and the bottom shell 304 may include other features or be formed with other shapes.

Figure 4A:
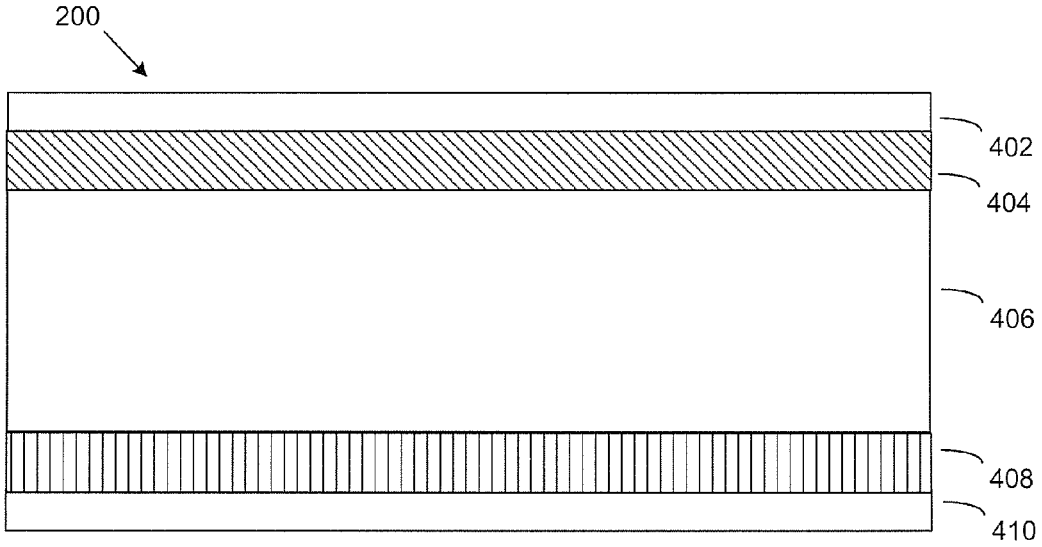
FIGS. 4A and 4B illustrate cross-section views of the metallic toilet lid, according to embodiments of the present disclosure.
Figure 4B:
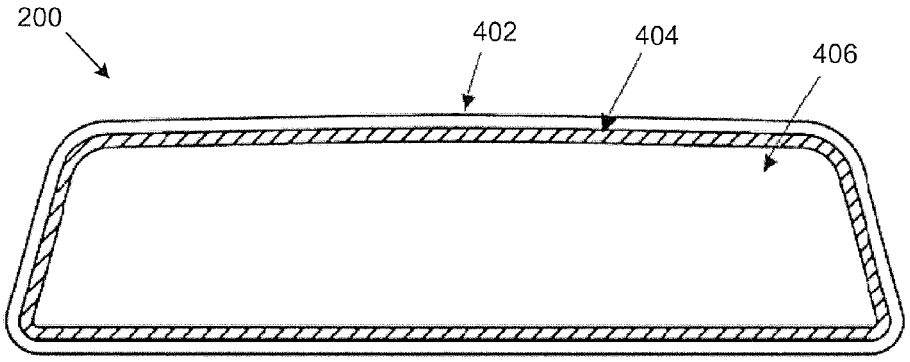

FIGS. 4A and 4B illustrate cross-section views of the metallic toilet lid 200, according to embodiments of the present disclosure. The embodiments of the toilet lid 200 shown in FIGS. 4A and 4B are for illustration only. Other embodiments of the toilet lid 200 could be used without departing from the scope of this disclosure. For ease of explanation, the following disclosure will refer only to the toilet lid 200. However, it will be understood that the embodiments described below are also applicable to a metallic toilet seat, such as the toilet seat 104.

As shown in FIG. 4A, the metallic toilet lid 200 comprises five layers 402-410. For clarity of illustration, the thickness of each layer 402-410 may not be drawn to scale. Layer 402 is an exterior finish or coating layer. Layer 404 is a first metallic layer. Layer 406 is a core layer. Layer 408 is a second metallic layer. In certain embodiments, the layer 408 may be composed of the same material as the layer 404. In other embodiments, the layer 408 may be composed of a different material than layer 404. Layer 410 is a second exterior finish or coating layer.

In accordance with the present disclosure, each of the metallic layers 404, 408 shown in FIG. 4A is formed of thin sheet metal that has been shaped as shown in FIG. 2. The metallic layers 404, 408 may represent the top shell 202 and the bottom shell 204 shown in FIG. 2. Either one or both of the metallic layers 404, 408 may be embossed, stamped, engraved, or printed with an image or decoration. The metallic layers 404, 408 may be embossed, stamped, engraved, or printed while still in sheet metal form, or after being cut from the sheet metal.

The exterior finish layers 402, 410 are applied to the exterior surfaces of the metallic layers 404, 408, as shown in FIG. 4A. The thickness of each finish layer 402, 410 may be selected according to the requirements of the application. In one embodiment, the thickness of each finish layer 402, 410 is approximately 0.5 millimeter (0.5 mm).

The exterior finish layers 402, 410 may be formed of ceramic or vitreous enamel that is sprayed or otherwise applied to the metallic layers 404, 408, and then cured or fired at a hot temperature (e.g., 1400°-1600° F.). The enamel finish layers 402, 410 provide a durable, scratch-resistant, colorfast surface for the metallic toilet lid or seat. The enamel coating could have a lower heat transfer coefficient than the metal used in the metallic layers 404, 408. The lower heat transfer coefficient reduces the heat transfer from the skin of the occupant to the seat, thus making the seat feel less cold and more comfortable.

While the exterior finish layers 402, 410 are described as enamel, the layers 402, 410 may be formed of any other suitable material that exhibits the advantageous properties of enamel. For example, the exterior finish layers 402, 410 may include one or more synthetic ceramic coatings, silicone, ultraviolet curable paint systems, crystallized varnish, or automotive grade coatings and paints.

In some embodiments, each exterior finish layer 402, 410 is opaque white. However, the exterior finish layers 402, 410 are not limited thereto. For example, either one or both of the exterior finish layers 402, 410 may be colored, tinted, mirrored, or clear and colorless. Either one or both of the exterior finish layers 402, 410 may be smooth or textured, and have a glossy or matte finish. Either one or both of the exterior finish layers 402, 410 may be plain, patterned, or include decorative pictures. Either one or both of the exterior finish layers 402, 410 may be embossed, stamped, or engraved with an image or decoration. In an embodiment, either or both exterior finish layers 402, 410 could be eliminated. That is, the metallic layers 404, 408 could have no exterior finish coating.

The core layer 406 may be formed of rigid polyurethane foam. The core layer 406 accounts for the majority of the thickness of the toilet lid 200 and provides most of the rigidity of the toilet lid 200. In one embodiment, the thickness of the core layer 406 is approximately fifteen millimeters (15 mm). The content and thickness of the core layer 406 may vary based on application requirements. For example, the foam in the core layer 406 can be more or less rigid, and more or less dense, depending on requirements.

In an embodiment, the cavity within the toilet lid shell or toilet seat shell is filled with rigid polyurethane foam, thereby forming core layer 406. The rigid polyurethane foam adds rigidity and structural strength to the shape of the toilet lid or seat. The rigid polyurethane foam also provides insulation to reduce heat transfer from the skin of the occupant.

Rigid polyurethane is produced by mixing two components in liquid form that chemically react with each other. The chemical reaction causes the urethane to expand throughout the cavity and crosslink, thereby forming a rigid aerated solid. The rigid urethane is injected in liquid form into the cavity through holes in the shell of the toilet lid or seat. In an embodiment, the holes may coincide with the fastener holes used for fasteners to mount hinges in the finished toilet lid or seat. The injection holes may also coincide with the holes for mounting the bumpers to the lid or seat. The foam is injected into the cavity after vitreous enameling or any other process step at hot temperature.

Although the core layer 406 is described as being formed of rigid polyurethane foam, other materials may be used. For example, the core layer 406 may be formed of other types of expandable foam, or any other suitable material.

In an embodiment, the exterior surface of the metallic toilet lid 200 (or a similarly formed metallic toilet seat) includes one or more decorative graphics. Each decorative graphic may represent any picture, graphic, text, or other image, and is customizable to appeal to a user of a toilet where the toilet lid 200 is installed. In certain embodiments, the decorative graphics may be chosen to match or coordinate with a particular decorative scheme of a bathroom or restroom where the toilet is installed. In other embodiments, the decorative graphics may be chosen to display or feature a logo or trademark of a business. In still other embodiments, the decorative graphics may be chosen to display or feature a picture or design that reflects an interest or hobby of a homeowner.

In one embodiment, the top or bottom shell of the toilet lid 200 can be formed with a flat recess. In the recess, artistic glass (e.g., Murano glass) can be inlayed and fired with the metal at high temperature, thereby seamlessly bonding the glass to the metal surface of the toilet lid. This allows the toilet lid to include countless artistic and beautiful designs incorporated into glass.

FIG. 4B illustrates a particular example of a full cross section view of the toilet lid 200, according to one embodiment. In FIG. 4B, the layers 402, 404 continue around all sides of the core layer 406. Thus, the bottom portion of the layer 402 replaces the layer 410, and the bottom portion of the layer 404 replaces the layer 408.

Although FIGS. 4A and 4B depicts examples of a metallic toilet lid 200, various changes may be made to FIGS. 4A and 4B. For example, while shown composed of five layers, the metallic toilet lid 200 may include more or fewer layers. Layers 402-410 may be removed, repeated, or arranged in a different order. Each layer 402-410 may be thicker or thinner than depicted in FIGS. 4A and 4B. Each layer 402-410 may include one or more sub-layers. Other layers, composed of the same or different materials, may be added to the metallic toilet lid 200.

Figure 5:
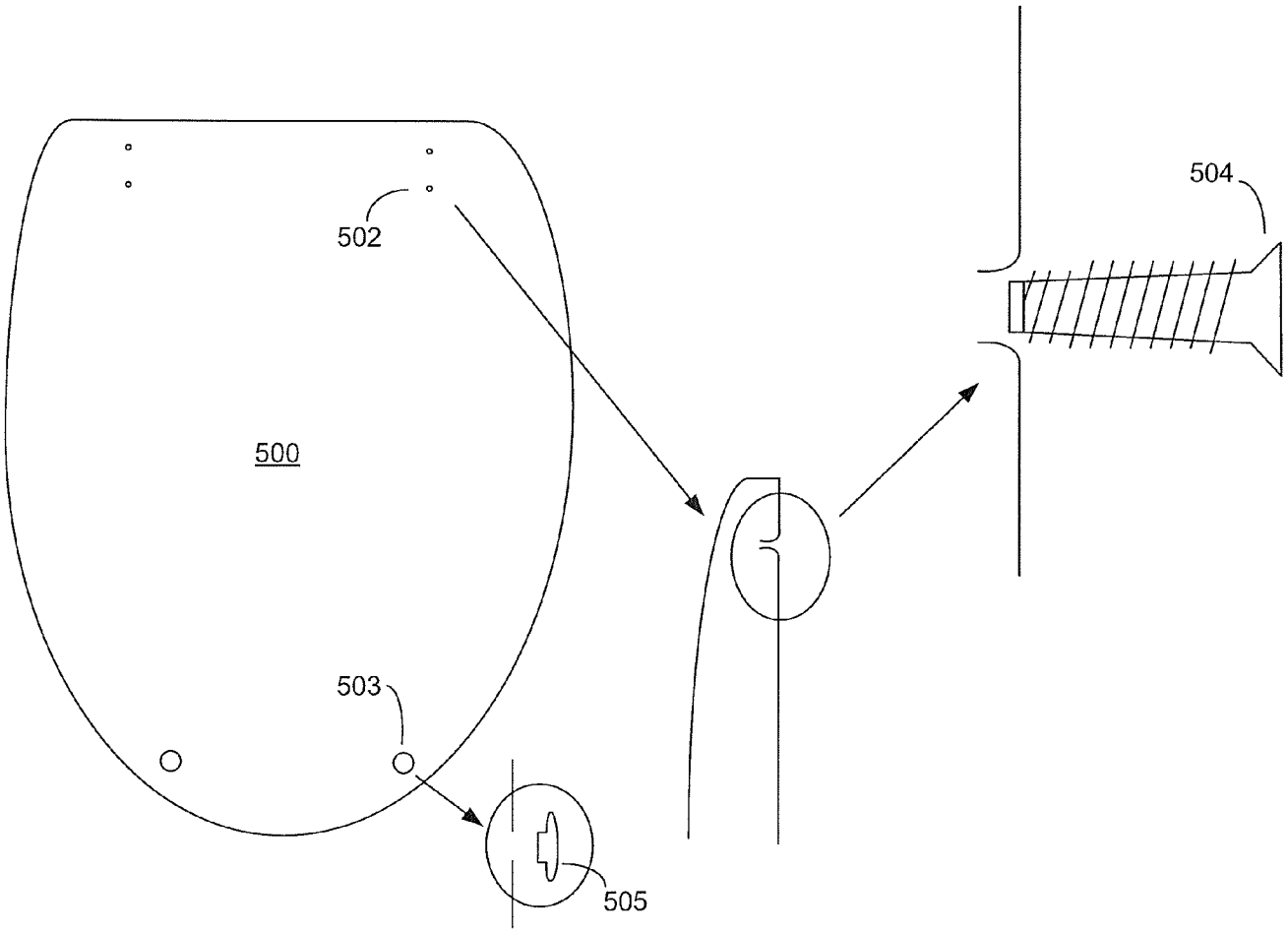
FIG. 5 illustrates example holes for attaching hinges, bumpers, or other hardware to a metallic toilet lid or seat, according to embodiments of the present disclosure.

FIG. 5 illustrates example holes for attaching hinges, bumpers, or other hardware to a metallic toilet lid or seat, according to embodiments of the present disclosure. The embodiment of the metallic toilet lid 500 shown in FIG. 5 is for illustration only. Other embodiments of the toilet lid 500 could be used without departing from the scope of this disclosure. The toilet lid 500 may represent the toilet lid 102 of FIG. 1 or the toilet lid 200 of FIG. 2. For ease of explanation, the following description will refer only to a metallic toilet lid. However, it will be understood that the embodiment described below is also applicable to a metallic toilet seat, such as the toilet seat 104.

As shown in FIG. 5, the toilet lid 500 includes a plurality of holes, represented by the holes 502 and 503. Some holes 502 are configured to accept a fastener 504, such as a self-threading steel screw. Using one or more fasteners 504 and holes 502, a mounting hinge or other hardware may be secured to the toilet lid 500. Other holes 503 may be configured to accept a bumper 505, which may be secured with or without a fastener or adhesive.

The holes 502, 503 additionally provide an opening into the interior space of the toilet lid 500. Liquid or aerosol material, such as expanding polyurethane foam, may be injected through one or more of the holes 502, 503 to form a core layer, such as the core layer 406 of FIGS. 4A and 4B. As the foam expands after injection into the interior space, portions of the foam may escape through one or more of the holes 502, 503 onto the surface of the toilet lid 500. Once it is cured, the escaped foam may be cut away or otherwise removed from the surface of the toilet lid 500.

Although FIG. 5 depicts examples of holes 502, 503 in a metallic toilet lid 500, various changes may be made to FIG. 5. For example, the metallic toilet lid 500 may include more or fewer holes 502, 503. The holes 502, 503 may be arranged differently, may be located in different locations in the metallic toilet lid 500, may have different dimensions, or may have different purposes.

Figure 6:
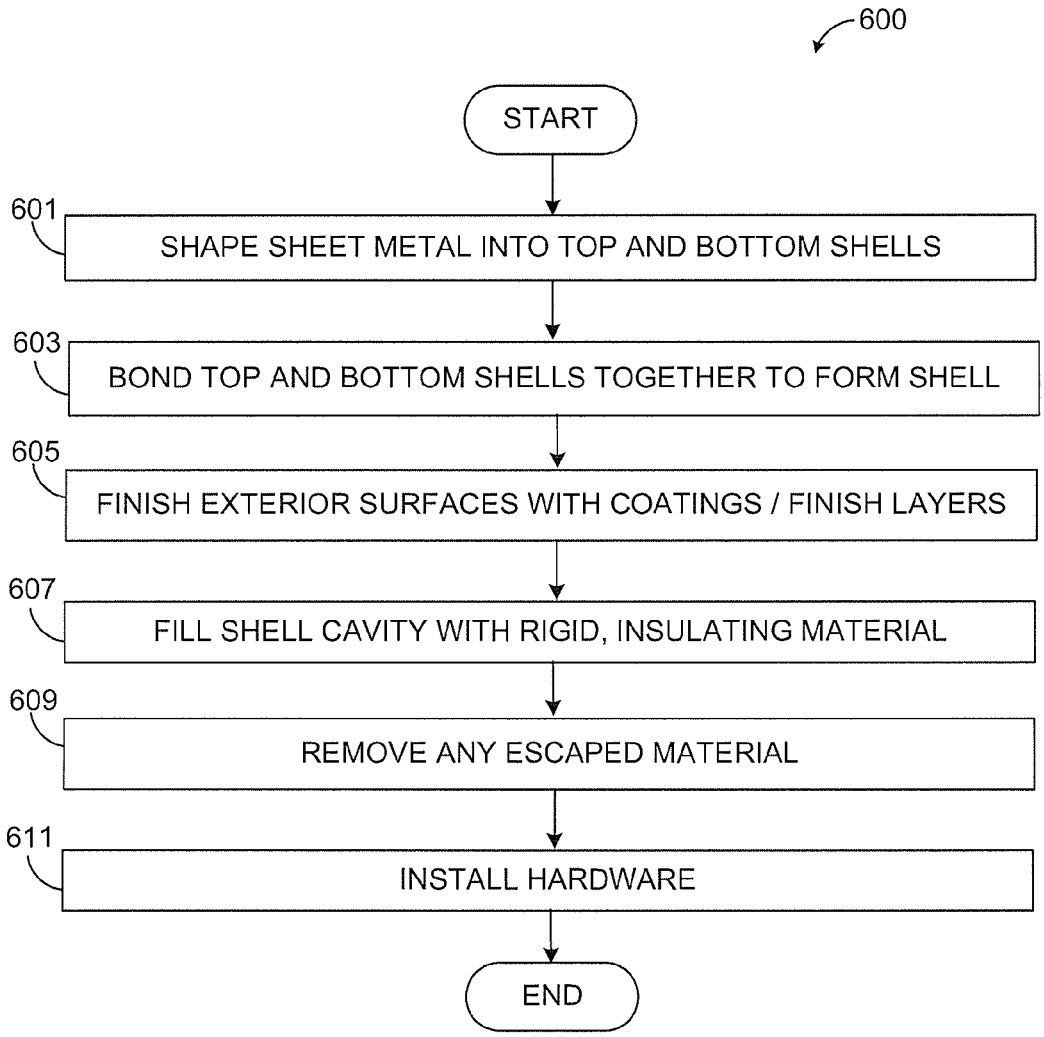
FIG. 6 depicts a method for manufacturing a metallic toilet lid or metallic toilet seat, according to the present disclosure.

FIG. 6 depicts a method for manufacturing a metallic toilet lid (e.g., toilet lids 102, 200) or metallic toilet seat (e.g., toilet seat 104), according to the present disclosure. The method shown in FIG. 6 is for illustration only. Other embodiments of the method could be used without departing from the scope of this disclosure.

Initially, in step 601, sheet metal (e.g., carbon steel sheet metal) is shaped into top and bottom shells for a toilet seat or toilet lid (e.g., top shell 202 and bottom shell 204). The top and bottom shells may have any suitable shape and dimensions. Next, in step 603, the top and bottom shells are permanently bonded together to form a whole shell for the toilet seat or toilet lid. The whole shell is initially hollow, with an interior cavity that is accessible via one or more holes in the shell (e.g., fastener holes 502 or bumper holes 503).

Next, in step 605, the exterior surfaces of the shell are finished with one or more coatings or finish layers (e.g., layers 402, 410). The finish layers may include a vitreous or porcelain enamel layer. The finish layers may also include one or more decorative layers, such as decorative glass that is installed in a recess on a surface of the shell. Next, in step 607, the cavity within the shell is filled by injecting material through one or more of the holes in the shell. The material may be a liquid or aerosol that expands throughout the cavity and cures into rigid polyurethane foam. Once cured, the foam provides rigidity and insulation to the finished toilet lid or toilet seat.

Next, in step 609, any foam that may have escaped from the cavity during expansion is removed from the exterior surface of the toilet lid or toilet seat. Then, in step 611, one or more hinges, bumpers, or other hardware are installed on the toilet lid or toilet seat.

Although FIG. 6 illustrates one example of a method for manufacturing a metallic toilet lid or seat, various changes may be made to FIG. 6. For example, while shown as a series of steps, various steps in FIG. 6 may overlap, occur in parallel, occur in a different order, or occur multiple times.

It may be advantageous to set forth definitions of certain words and phrases used throughout this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus for use with a toilet, the apparatus comprising:

first and second metallic layers, the first metallic layer having a tab that extends around a perimeter of the first metallic layer, the tab projecting upward at a substantially right angle from a planar surface of the first metallic layer, the tab of the first metallic layer bonded to an edge of the second metallic layer to form a shell having a shape and size associated with the toilet apparatus, the shell having an interior volume;

a core structural layer disposed within the interior volume of the shell; and a plurality of exterior layers disposed over exterior surfaces of the shell, the exterior layers configured to envelop the toilet apparatus.

2. The apparatus of claim 1, wherein the apparatus comprises at least one of a toilet lid and a toilet seat.

3. The apparatus of claim 1, wherein each of the first and second metallic layers is formed of carbon steel sheet metal.

4. The apparatus of claim 1, wherein the core structural layer comprises rigid polyurethane foam.

5. The apparatus of claim 1, wherein each exterior layer comprises one or more of vitreous enamel, ceramic enamel, a synthetic ceramic coating, crystallized varnish, silicone, ultraviolet curable paint, and automotive grade paint.

6. The apparatus of claim 1, further comprising at least one decorative graphic layer disposed over one of the exterior layers.

7. The apparatus of claim 6, wherein the at least one decorative graphic layer is a decorative glass layer disposed in a recess in an exterior surface of the toilet apparatus.

8. A method of manufacturing a toilet apparatus, the method comprising:

forming first and second metallic layers, the first metallic layer formed with a tab that extends around a perimeter of the first metallic layer, the tab projecting upward at a substantially right angle from a planar surface of the first metallic layer;

bonding the tab of the first metallic layer to an edge of the second metallic layer to form a shell having a shape and size associated with the toilet apparatus, the shell having an interior volume;

applying a plurality of exterior layers over exterior surfaces of the shell, the exterior layers configured to envelop the toilet apparatus; and injecting a core structural material into the interior volume of the shell.

9. The method of claim 8, wherein the apparatus comprises at least one of a toilet lid and a toilet seat.

10. The method of claim 8, wherein each of the first and second metallic layers is formed of carbon steel sheet metal.

11. The method of claim 8, wherein the core structural material comprises rigid polyurethane foam.

12. The method of claim 8, wherein each exterior layer comprises one or more of vitreous enamel, ceramic enamel, a synthetic ceramic coating, crystallized varnish, silicone, ultraviolet curable paint, and automotive grade paint.

13. The method of claim 8, further comprising applying at least one decorative graphic layer over one of the exterior layers.

14. The method of claim 13, wherein the at least one decorative graphic layer is a decorative glass layer disposed in a recess in an exterior surface of the toilet apparatus.

15. A toilet comprising:

a toilet bowl; and a toilet seat and a toilet lid secured to the toilet bowl, wherein at least one of the toilet seat or the toilet lid comprises:

first and second metallic layers, the first metallic layer having a tab that extends around a perimeter of the first metallic layer, the tab projecting upward at a substantially right angle from a planar surface of the first metallic layer, the tab of the first metallic layer bonded to an edge of the second metallic layer to form a shell having a shape and size associated with the toilet seat or lid, the shell having an interior volume;

a core structural layer disposed within the interior volume of the shell; and a plurality of exterior layers disposed over exterior surfaces of the shell, the exterior layers configured to envelop the toilet seat or lid.

16. The toilet of claim 15, wherein each of the first and second metallic layers is formed of carbon steel sheet metal.

17. The toilet of claim 15, wherein the core structural layer comprises rigid polyurethane foam.

18. The toilet of claim 15, wherein each exterior layer comprises one or more of vitreous enamel, ceramic enamel, a synthetic ceramic coating, crystallized varnish, silicone, ultraviolet curable paint, and automotive grade paint.

19. The toilet of claim 15, further comprising at least one decorative graphic layer disposed over one of the exterior layers.

20. The toilet of claim 19, wherein the at least one decorative graphic layer is a decorative glass layer disposed in a recess in an exterior surface of the toilet seat or lid.

* * * * *